US010406392B2

(12) United States Patent
Stephens

(10) Patent No.: US 10,406,392 B2
(45) Date of Patent: Sep. 10, 2019

(54) METHODS AND SYSTEMS FOR OVERCURRENT PROTECTION IN A FIRE PUMP CONTROL SYSTEM

(71) Applicant: ASCO Power Technologies, L.P., Florham Park, NJ (US)

(72) Inventor: Douglas A. Stephens, Cary, NC (US)

(73) Assignee: ASCO Power Technologies, L.P., Florham Park, NJ (US)

( * ) Notice: Subject to any disclaimer, the term of this patent is extended or adjusted under 35 U.S.C. 154(b) by 346 days.

(21) Appl. No.: 15/196,685

(22) Filed: Jun. 29, 2016

(65) Prior Publication Data

US 2016/0375289 A1 Dec. 29, 2016

Related U.S. Application Data

(60) Provisional application No. 62/185,754, filed on Jun. 29, 2015.

(51) Int. Cl.
*A62C 37/00* (2006.01)
*A62C 35/68* (2006.01)

(52) U.S. Cl.
CPC ..... *A62C 37/00* (2013.01); *A62C 35/68* (2013.01)

(58) Field of Classification Search
CPC ..... A62C 35/68; A62C 37/00; G05B 19/416; G05B 2219/37371
See application file for complete search history.

(56) References Cited

U.S. PATENT DOCUMENTS 5,221,189 A * 6/1993 Henningsen ..... F04B 49/022 417/12
5,323,307 A * 6/1994 Wolf ..... H02J 3/14 700/22
6,998,807 B2 * 2/2006 Phillips ..... F04B 17/03 318/455
9,745,974 B2 * 8/2017 Phillips ..... F04B 49/06
2005/0183868 A1 * 8/2005 Taylor ..... A62C 37/44 169/51

(Continued)

OTHER PUBLICATIONS

Cenzori et al. "Common Electrical Code Topics" Mar. 27, 2015, Ohio Board of Building Standards, pp. 9-11 (Year: 2015).*

(Continued)

*Primary Examiner* — Kenneth M Lo
*Assistant Examiner* — Chad G Erdman
(74) *Attorney, Agent, or Firm* — Locke Lord LLP

(57) ABSTRACT

Methods and systems for a fire pump control system are provided. An example fire pump control system includes a pump system having a given full load current, wherein the pump system comprises (i) a fire pump, (ii) a first disconnect switch and (iii) a first circuit breaker. The first disconnect switch and the first circuit breaker are located upstream of the fire pump. The system further includes a controller configured to control operation of the fire pump, and the controller comprises a second disconnect switch and a second circuit breaker. The controller is located upstream of the first disconnect switch and the first circuit breaker, and is configured to avoid (i) opening within two minutes at 600 percent of the full load current, (ii) opening with a restart transient of 24 times the full load current, and (iii) opening within 10 minutes at 300 percent of the full load current.

18 Claims, 5 Drawing Sheets

(56) References Cited

U.S. PATENT DOCUMENTS

| | | | | |
|---|---|---|---|---|
| 2010/0012333 | A1* | 1/2010 | Fisher | F16K 37/0091 169/24 |
| 2010/0138054 | A1* | 6/2010 | Goupil | A62C 35/68 700/282 |
| 2011/0052423 | A1* | 3/2011 | Gambier | F04B 49/065 417/63 |
| 2011/0056707 | A1* | 3/2011 | Gamble | A62C 5/02 169/14 |
| 2011/0140902 | A1* | 6/2011 | Huss | H01H 85/32 340/638 |
| 2016/0043594 | A1* | 2/2016 | Yamaguchi | H02J 3/14 307/24 |
| 2016/0175633 | A1* | 6/2016 | Smith | A62C 35/60 169/61 |
| 2016/0225562 | A1* | 8/2016 | Franks | H02H 3/006 |
| 2017/0100617 | A1* | 4/2017 | Kochelek | A62C 37/50 |

OTHER PUBLICATIONS

Cote, Arthur E. "Operation of Fire Protection Systems" 2003, National Fire Protection Association, Inc. p. 253. (Year: 2003).*

* cited by examiner

METHODS AND SYSTEMS FOR OVERCURRENT PROTECTION IN A FIRE PUMP CONTROL SYSTEM

CROSS-REFERENCE TO RELATED APPLICATION

This application claims the benefit of U.S. Provisional Application No. 62/185,754, filed on Jun. 29, 2015, the contents of which are hereby incorporated by reference in their entirety.

BACKGROUND

Sprinkler systems are installed in buildings to reduce destruction caused by fires. A fire protection system may comprise a sprinkler system and/or a standpipe system. A sprinkler system is an active fire protection measure that provides adequate pressure and flow to a water distribution piping system, onto which a plurality of fire sprinklers is connected. Each closed-head sprinkler can be triggered once an ambient temperature around the sprinkler reaches a design activation temperature of the individual sprinkler head. In a standard wet-pipe sprinkler system, each sprinkler activates independently when the predetermined heat level is reached. Because of this, the number of sprinklers that operate is limited to only those near the fire, thereby maximizing the available water pressure over the point of fire origin. A standpipe system is another type of fire protection measure consisting of a network of vertical piping installed in strategic locations within a multi-story building. The vertical piping may deliver large volumes of water to any floor of the building to supply hose lines of firefighters, for example.

FIG. 1 illustrates a block diagram of a prior art fire pump installation 100. The fire pump installation 100 includes an electric motor driven fire pump 102 which is driven by an electric motor. The electric motor driven fire pump is further connected to a water source 104. The water source 104 provides water flow at a pressure to a fire protection system 106. Generally, fire pumps are needed when a water source cannot provide sufficient pressure to meet hydraulic design requirements of a fire protection system. This usually occurs in a building that is tall, such as a high-rise building, or in a building that requires a relatively high terminal pressure in the fire protection system 106 to provide a large volume of water, such as a storage warehouse. Thus, the fire pump 102 may be installed to boost the water source supply line pressure and maintain system pressure to meet the pressure and flow demands of the fire protection system 106.

The electric motor driven fire pump 102 starts under operation of the electric motor when a pressure in the fire protection system 106 drops below a certain predetermined start pressure. A pressure sensing line 118 is provided which allows the fire pump controller 110 to monitor system pressure. For example, the pressure in the fire protection system 106 may drop significantly when one or more fire sprinklers are exposed to heat above their design temperature, and open, releasing water. Alternately, fire hose connections to standpipe systems may be opened by firefighters causing a pressure drop in the fire protection system 106. In one instance, the fire pump may have a rating between 3 and 3500 horsepower (HP).

The fire pump installation 100 also includes an electric motor driven pressure maintenance pump, which also may be referred to as a make-up pump or a jockey pump 108. Operatively coupled to an electric motor, the jockey pump 108 is intended to maintain pressure in the fire protection system 106 so that the electric motor and hence the fire pump 102 does not need to constantly run. A pressure sensing line 120 is provided which allows the jockey pump controller 108 to monitor system pressure. For example, the jockey pump 108 maintains pressure to an artificially high level so that the operation of a single fire sprinkler will cause a pressure drop that will be sensed by a fire pump controller 110, causing the fire pump 102 to start. In some examples, the jockey pump 108 may have a rating between ¼ and 100 HP.

In one example, the jockey pump 108 may provide makeup water pressure for normal leakage within the system (such as packing on valves, seepage at joints, leaks at fire hydrants) and inadvertent use of water from the water source 104. When the fire pump 102 starts, a signal may be sent to an alarm system of a building to trigger a fire alarm. Nuisance operation of the fire pump 102 (as well as the electric motor operating the fire pump 102) may eventually cause fire department intervention and increase wear on the fire pump 102. Thus, it is generally desired to either reduce and/or avoid any nuisance or unintended operation of the fire pump 102 and accompanying fire pump motor.

The jockey pump 108 may also include a jockey pump controller 112. Each of the fire pump controller 110 and jockey pump controller 112 may comprise a microprocessor-based controller that can be used to adjust start and stop set points. For example, the fire pump controller 110 may automatically cause the fire pump 102 to start or the jockey pump controller 112 may automatically cause the jockey pump 108 to start when a water pressure is below a pressure set point. The jockey pump controller 112 may have a start pressure set point of approximately five to ten pounds per square inch (psi) greater than the start pressure point of the fire pump controller 110. In this manner, the jockey pump controller 112 cycles the jockey pump to maintain the fire protection system 106 at a predetermined pressure well above the start setting of the fire pump 102 so that the fire pump 102 only runs when a fire occurs or the jockey pump 108 is overcome by a larger than normal loss in system pressure.

The fire installation system 100 also includes check valves 114 and gate valves 116. The check valves 114 are used in the fire pump installation 100 to allow the flow of water in one direction only for the purpose of building pressure in the fire protection system 106. Check valves 114 are installed between the outlets of each of the fire pump 102 and jockey pump 108, and the fire protection system 106. The gate valves 116 are installed on the inlets and outlets of each of the fire pump 102 and jockey pump 108 and are used to isolate either the fire pump 102 or jockey pump 108 from the fire protection system 106 and water source 104 for maintenance or other purposes.

The fire pump installation 100 may receive power from a power source such as a utility power service. In an example, the fire pump installation may have a direct connection to the utility power source. FIG. 2 illustrates a fire pump control system 200, in which a fire pump installation has a direct connection 202 of the service conductors 204 from the utility power source 206 (e.g., transformer) to the fire pump controller 208.

SUMMARY

In one example aspect, a fire pump control system is provided. The fire pump control system comprises a pump system having a given full load current, wherein the pump system comprises (i) a fire pump, (ii) a first disconnect switch and (iii) a first circuit breaker. The first disconnect switch and the first circuit breaker are located upstream of the fire pump. The fire pump control system also comprises a controller configured to control operation of the fire pump, and the controller comprises a second disconnect switch and a second circuit breaker. The controller is located upstream of the first disconnect switch and the first circuit breaker, and the controller is configured to avoid (i) opening within two minutes at 600 percent of the full load current, (ii) opening with a restart transient of 24 times the full load current, and (iii) opening within 10 minutes at 300 percent of the full load current.

In another example, the fire pump control system includes a pump system having a given full load current, wherein the pump system comprises (i) a fire pump, (ii) a maintenance pump, (iii) a first disconnect switch and (iv) a first circuit breaker. The first disconnect switch and the first circuit breaker are located upstream of the fire pump and maintenance pump. The fire pump system further includes a controller configured to control operation of at least one of the fire pump or the maintenance pump, and the controller comprises a second disconnect switch and a second circuit breaker. The controller is located upstream of the first disconnect switch and the first circuit breaker, and the controller is configured to avoid (i) opening within two minutes at 600 percent of the full load current, (ii) opening with a restart transient of 24 times the full load current, and (iii) opening within 10 minutes at 300 percent of the full load current.

In still another example, a method operable in a fire pump control system is provided. The fire pump control system includes a pump system having a given full load current, wherein the pump system comprises (i) a fire pump, (ii) a maintenance pump, (iii) a first disconnect switch and (iv) a first circuit breaker. The method involves installing a controller upstream of the first disconnect switch and first circuit breaker, wherein the controller is configured to control operation of at least one of the fire pump or the maintenance pump, wherein the controller comprises a second disconnect switch and a second circuit breaker. The controller is further configured to avoid (i) opening within two minutes at 600 percent of the full load current, (ii) opening with a restart transient of 24 times the full load current, and (iii) opening within 10 minutes at 300 percent of the full load current.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
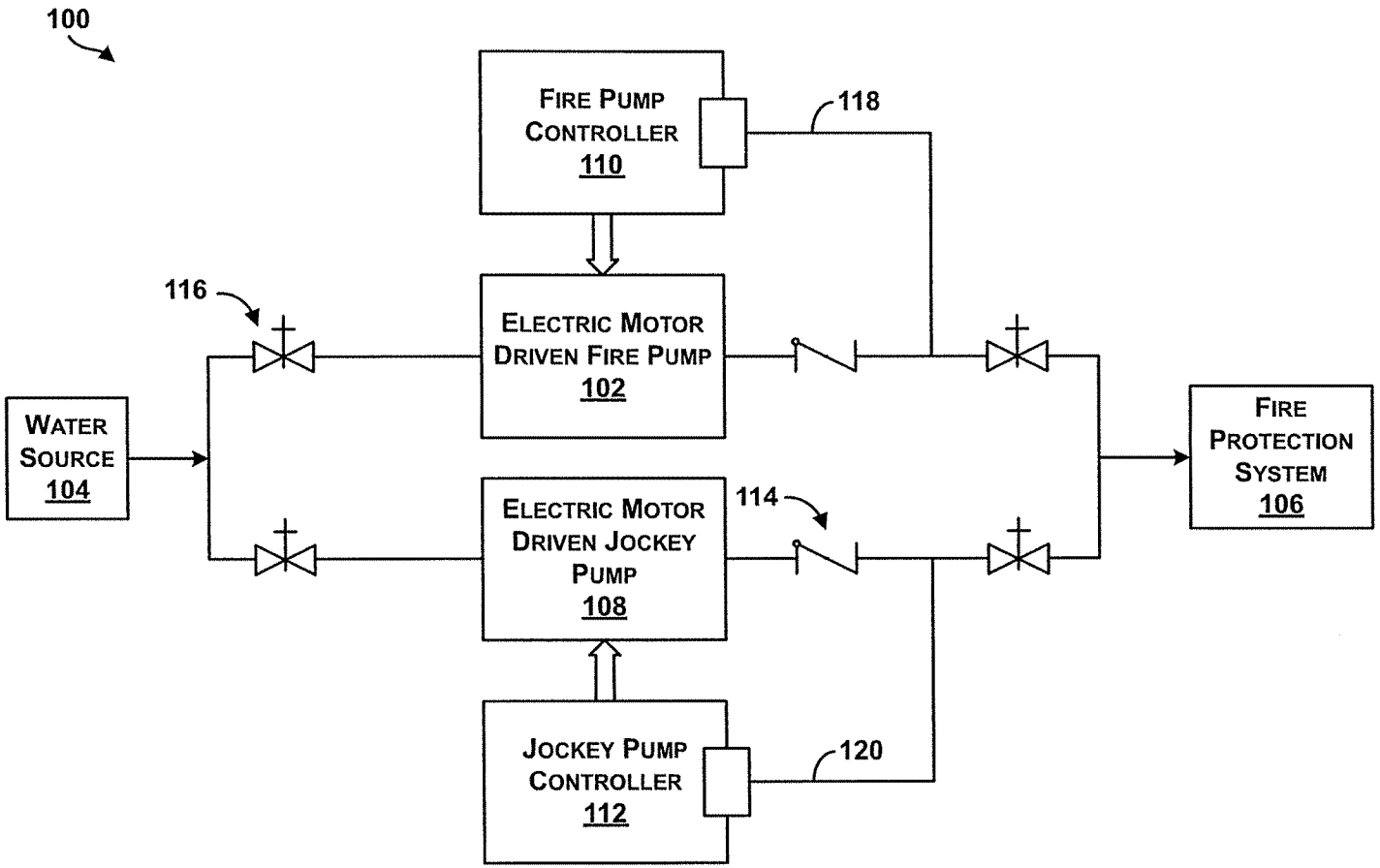
FIG. 1 PRIOR ART
FIG. 1 illustrates a block diagram of a prior art fire pump installation.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The example method and system provides for an improved connection between a power source and a fire pump. In particular, the example method and system provides an overcurrent protection device for a fire pump system that offers significant advantages over existing systems.

Figure 2:
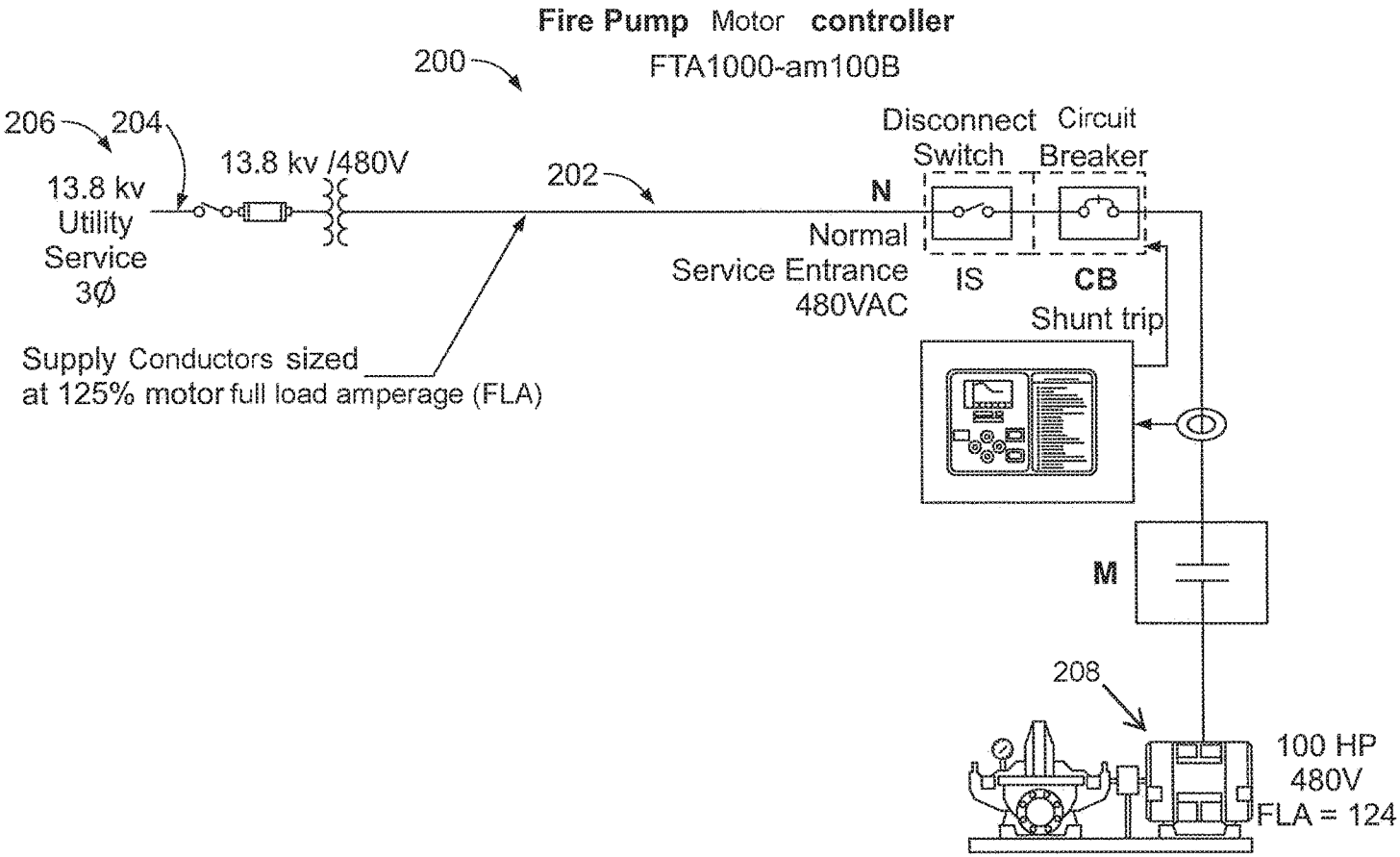
FIG. 2 PRIOR ART
FIG. 2 illustrates a prior art fire pump control system having a direct connection of the service conductors from the transformer to the fire pump controller.

As mentioned above, FIG. 2 illustrates a prior art fire pump control system 200 having a direct connection 202 of the service conductors 204 from the utility power source 206 (e.g., transformer) to the fire pump controller 208. One primary advantage of a direct connection of the service conductors from the utility power source is that it provides a highly reliable connection with limited or no means of service interruption. However, a direct connection of the service conductors from the utility power source to the fire pump controller has various disadvantages and limitations. As a particular example, a direct connection results in potential safety hazards while maintenance is being performed in the fire pump control room, such as the risk of arc flashes.

In order to improve safety conditions while maintenance is being performed in the fire pump control room (e.g., maintenance on system components such as the fire pump and/or fire pump controller), power may be disconnected from the fire pump and fire pump controller. One way to remove power from the fire pump controller is to disconnect the service conductors at the transformers (i.e., at the utility power source). However, typically, even though the isolating switch in the fire pump controller removes power from the load (including the breaker), the incoming terminals on the isolating switch nevertheless remain live. This situation poses a potential safety hazard, and such a safety hazard is both dangerous and often not acceptable in many jurisdictions.

In the United States, standards for operation of fire pump systems are provided by National Fire Protection Association (NFPA) 20 entitled "Standard for the Installation of Stationary Pumps for Fire Protection." NFPA 20 permits the use of a single disconnecting means upstream of the fire pump controller. This single upstream disconnecting means provides the fire pump installation with more flexibility and improved safety. NFPA20 specifies that the single upstream disconnecting means include overcurrent protection, supervision, and a disconnect means lockable in the "on" position. Further, these upstream disconnecting means, which include overcurrent protection, were required to carry the locked-rotor current of the fire pump motor "indefinitely". Still further, the upstream disconnect means were typically either fusible disconnects or thermal magnetic breakers in accordance with Article 430.52 of the National Electrical Code (NEC). As a result of these requirements, an upstream fusible disconnect or a thermal magnetic breaker would, for example, require a 1200 amp frame size for a 125 HP fire pump motor (156 FLA×600%). For larger fire pumps, even larger amp frame size would be required for the single disconnecting means.

In either case of a disconnecting means of an upstream fusible disconnect or a thermal magnetic breaker, the equipment is both large and expensive. Due to the size and expense of such disconnecting means, in practice, these requirements have often been ignored in many cases, leading to the unauthorized use of various work-around upstream disconnect solutions. Example unauthorized work-around solutions include a knife switch with no overcurrent protection, a fusible disconnect with pieces of bus bars installed in place of fuses, and magnetic-only breakers that may not be properly coordinated with the fire pump controller. Revisions to NFPA 20-2013 permit the use of a listed assembly for fire pump service as an alternate solution for overcurrent protection. According to the NFPA 20-2013 revisions, the overcurrent protection in the listed assembly is not required to pass locked-rotor currently indefinitely.

The disclosed methods and systems offer an improved way to handle both (i) overcurrent protection for a pump system and (ii) control of the pump system. By providing a controller in accordance with the disclosure upstream of the fire pump room, the controller may act as an overcurrent protection device and also provide enhanced functionality for the fire pump system. In addition to providing overcurrent protection and greater functionality to the fire pump system than existing overcurrent protection devices, a controller in accordance with the disclosure is also beneficially less costly than existing overcurrent protection devices.

In accordance with the disclosure, an example fire pump control system includes: (i) a pump system having a given full load current, wherein the pump system comprises (a) a fire pump, (b) a first disconnect switch and (c) a first circuit breaker, wherein the first disconnect switch and the first circuit breaker are located upstream of the fire pump; and (ii) a controller configured to control operation of the fire pump, wherein the controller comprises a second disconnect switch and a second circuit breaker, wherein the controller is located upstream of the first disconnect switch and the first circuit breaker, and wherein the controller is configured to avoid (i) opening within two minutes at 600 percent of the full load current, (ii) opening with a restart transient of 24 times the full load current, and (iii) opening within 10 minutes at 300 percent of the full load current.

An example method in accordance with the disclosure is operable in a fire pump control system comprising a pump system having a given full load current, wherein the pump system comprises (i) a fire pump, (ii) a maintenance pump, (iii) a first disconnect switch and (iv) a first circuit breaker. The example method includes installing a controller upstream of the first disconnect switch and first circuit breaker, wherein the controller is configured to control operation of at least one of the fire pump or the maintenance pump, wherein the controller comprises a second disconnect switch and a second circuit breaker. In an example, the disclosed method and system may be utilized in new fire pump system installation scenarios to provide enhanced control and enhanced functionality to newly installed fire pump systems. In another example, the disclosed method and system may also be operable to upgrade existing fire pump systems to provide greater control and functionality to existing legacy fire pump systems.

Figure 3:
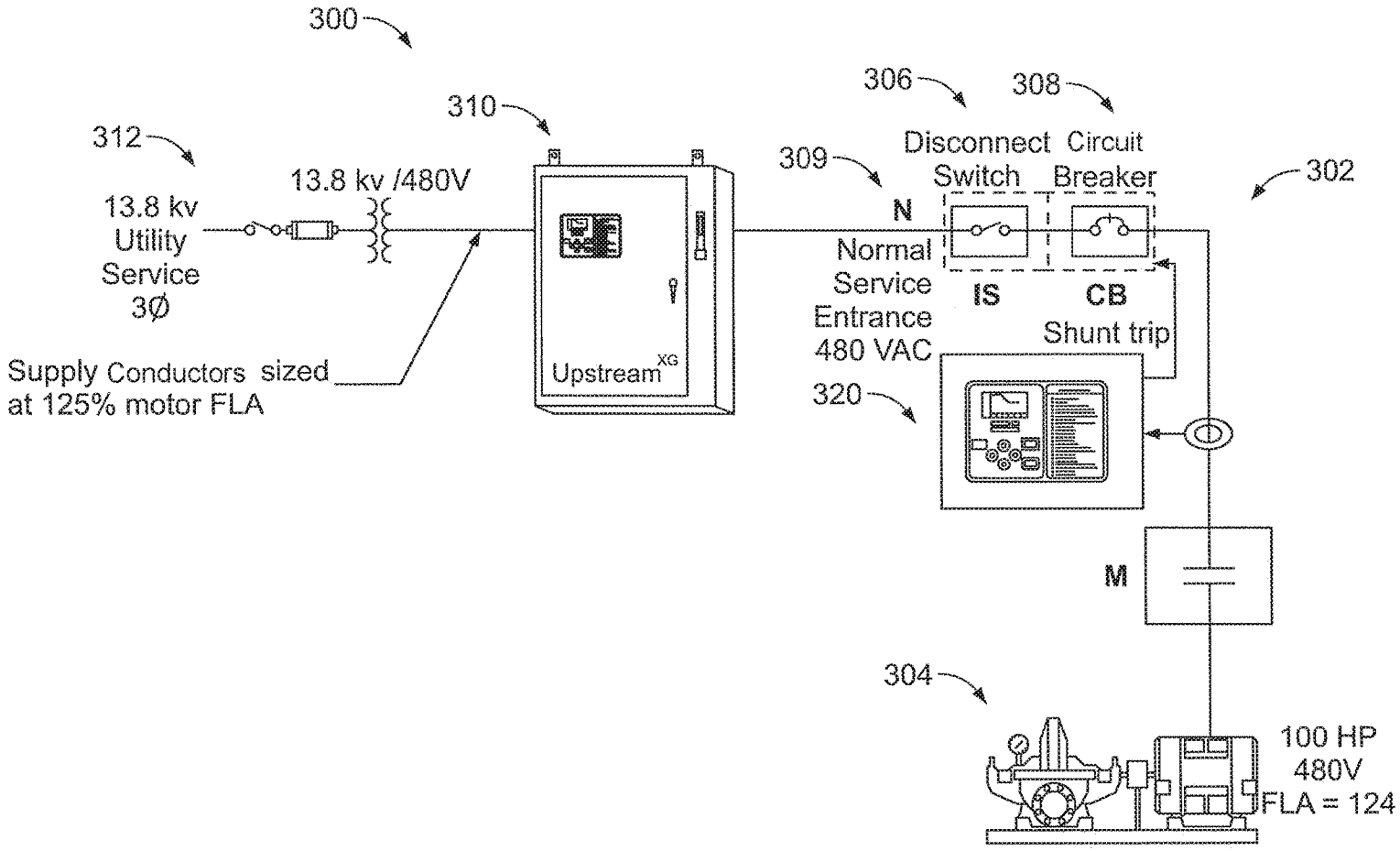
FIG. 3 illustrates an example fire pump control system in accordance with an example embodiment of the present disclosure.
Figure 4:
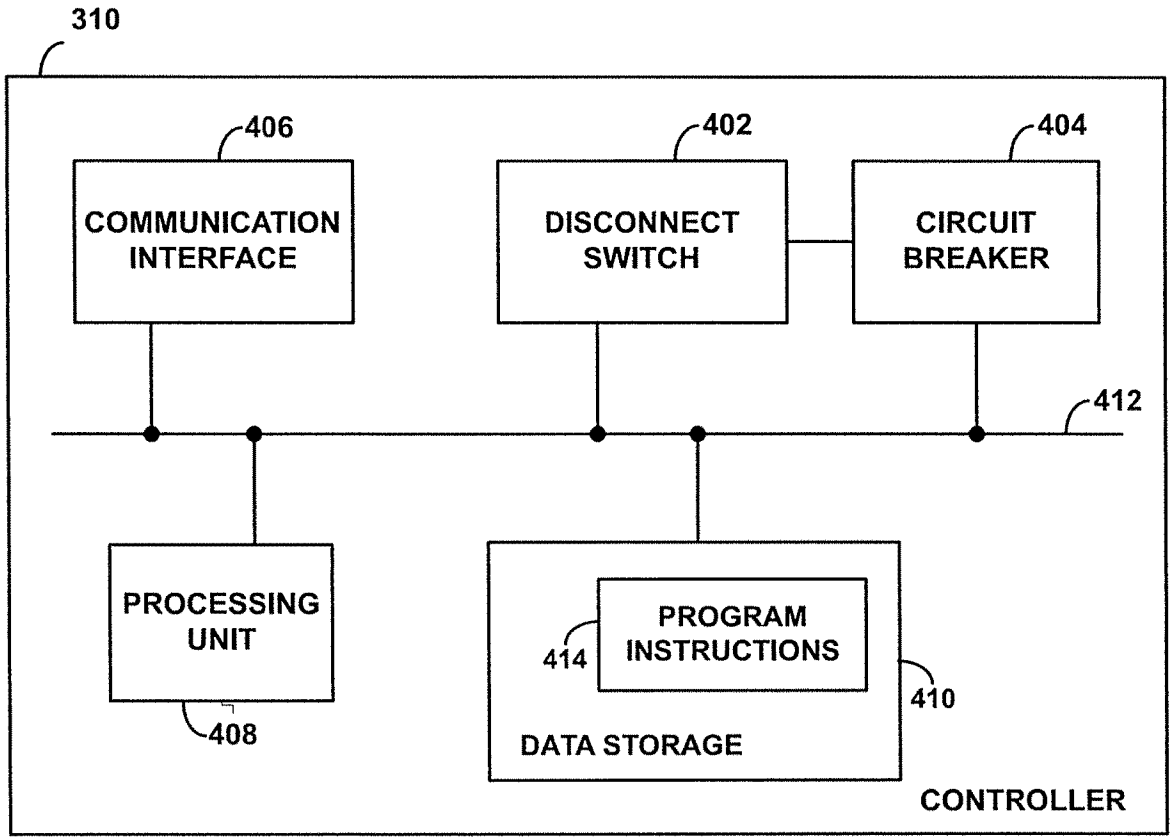
FIG. 4 illustrates an example controller of the fire pump system of FIG. 3.

FIG. 3 illustrates an example fire pump control system 300 in accordance with an example embodiment of the present disclosure. The fire pump control system 300 includes a pump system 302 that is connected to utility power source 312. The pump system 302 is configured such that during operation the pump system has a given full load current. This full load current is the amount of current used by the pump system when the pump system is operating at full-load capacity. The pump system includes a fire pump 304, a disconnect switch 306, and a circuit breaker 308. The pump system 302 may also include a jockey pump. As shown in FIG. 3, the disconnect switch 306 and the circuit breaker 308 are located upstream of the fire pump 304. Further, typically the disconnect switch and the circuit breaker of a pump system are located downstream of a pump-system service entrance. For instance, as shown in FIG. 3, the first disconnect switch 306 and the first circuit breaker 308 are located downstream of service entrance 309. During maintenance of the pump system 302, maintenance can trigger the disconnect switch upon entering the service entrance in order to perform fire-pump maintenance operations Fire pump control system 300 further includes a controller 310 configured to control operation of the fire pump 304 and to act as an overcurrent protection device for the pump system 302. Controller 310 may include various components so as to allow the controller to control operation of the fire pump 304 and to act as an overcurrent protection device for the pump system 302. FIG. 4 is a simplified block diagram of controller 310 showing some of the physical components that such a controller may include. As shown in FIG. 4, the controller 310 includes a disconnect switch 402, a circuit breaker 404, a communication interface 406, a processing unit 408, and data storage 410, all of which may be communicatively linked together by a system bus, network, or other connection mechanism 412.

With this arrangement, the communication interface 406 may function to provide for communication with various other fire pump system elements and may thus take various forms, allowing for wired and/or wireless communication for instance. Processing unit 408 may then comprise one or more general purpose processors (e.g., microprocessors) and/or one or more special purpose processors (e.g., application specific integrated circuits) and may be integrated in whole or in part with the communication interface. And data storage 410 may comprise one or more volatile and/or non-volatile storage components, such as optical, magnetic, or flash memory and may be integrated in whole or in part with the processing unit. As shown, by way of example, data storage 410 may then comprise program instructions 414, which may be executable by processing unit 408 to carry out various functions described herein.

In an exemplary embodiment, data storage 410 may include program instructions that are executable to cause the controller 310 to perform various control functions. For instance, data storage 410 may include program instructions that are executable to cause the controller 310 to perform functions comprising: (i) receiving a signal indicating a pressure value, and (ii) comparing the pressure value to a threshold for initiating operation of the fire pump; and (iii) storing event statistics that are representative of fire pump operation. Other example functions such as control and monitoring functions of controller 310 will be described in greater detail below.

Returning to FIG. 3, the controller 310 is located upstream of disconnect switch 306 and breaker 308, and utility service 312 is upstream of the controller 310. As such, the controller 310 may serve as an overcurrent protection device for the pump system 302 and fire pump 304. Still further, the controller 310 is configured to avoid (i) opening within two minutes at 600 percent of the full load current, (ii) opening with a restart transient of 24 times the full load current, and (iii) opening within 10 minutes at 300 percent of the full load current. In particular, second disconnect switch 402 and second circuit breaker 404 may be configured to avoid (i) opening within two minutes at 600 percent of the full load current, (ii) opening with a restart transient of 24 times the full load current, and (iii) opening within 10 minutes at 300 percent of the full load current. In an example, a trip point for the second circuit breaker is not field-adjustable. Further, circuit breaker 404 may be any suitable circuit breaker, such as a magnetic circuit breaker.

FIG. 3 shows example voltage values, an example full load amp value, and an example pump horsepower. These depicted values are provide merely as an example and are not intended to be limiting. Other suitable values are possible as well.

In an example, the controller is not configured to carry the locked-rotor current of the fire pump system indefinitely. As such, the upstream controller in accordance with the present disclosure may be less expensive than a disconnecting means configured to carry the locked-rotor current of the fire pump system indefinitely.

As mentioned above, the controller 310 may be configured to communicate with fire pump system 302 or elements of the fire pump system (e.g., fire pump 304). For instance, controller 310 may be directly connected to the fire pump 304 so as to control operation of the fire pump 304. In another example, fire pump 304 may be connected to a second controller such as fire pump controller 320, and the controller 310 may be connected to the fire pump 304 via the fire pump controller 320.

Figure 5:
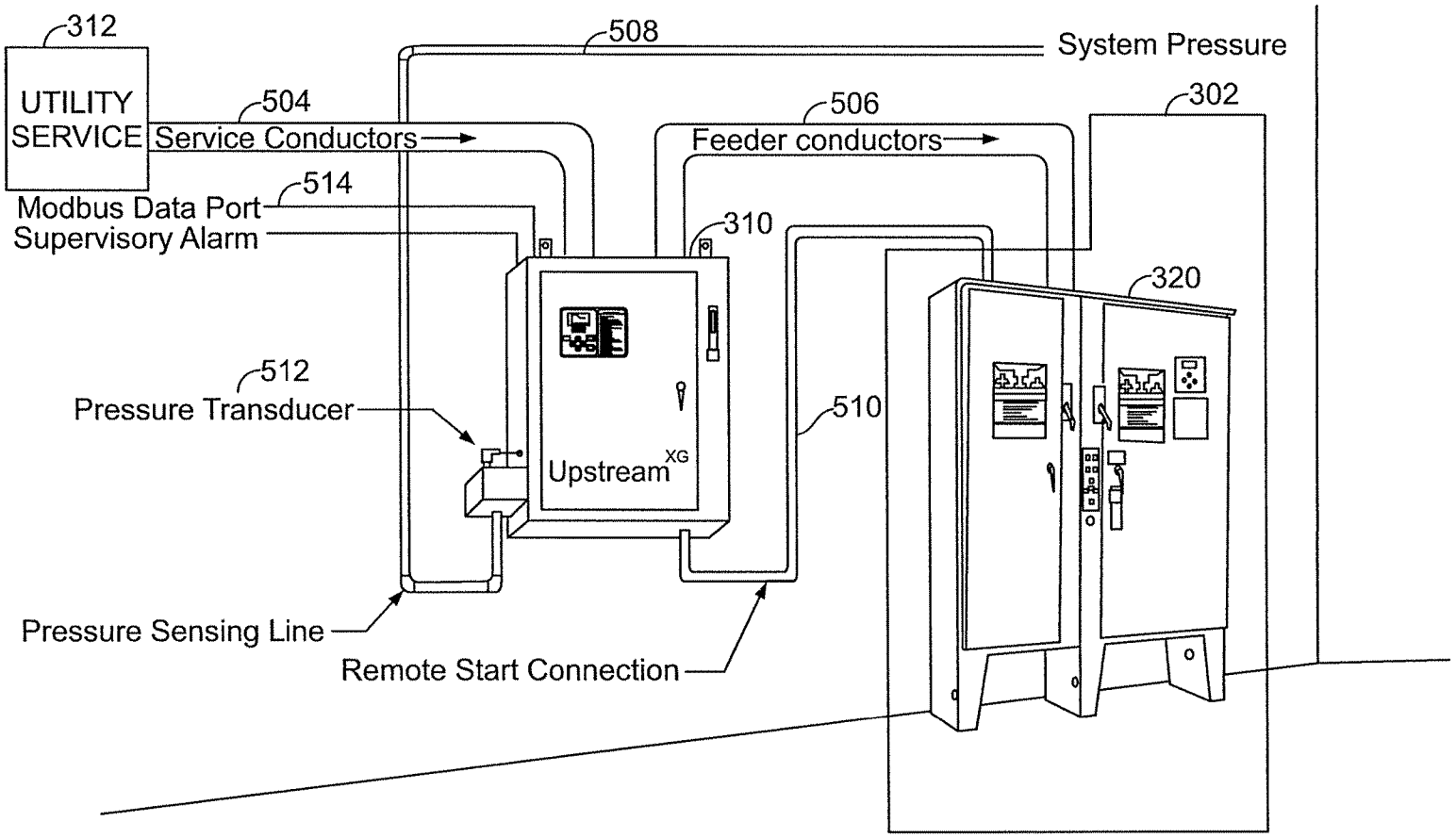
FIG. 5 illustrates example connections of the fire pump control system of FIG. 3.

FIG. 5 illustrates example connections between an upstream controller (e.g., upstream of the service entrance) and a fire pump system or component(s) of a fire pump system. In particular, FIG. 5 illustrates example connections between controller 310 and controller 320. Controller 310 and controller 320 may communicate with one another, exchanging information such as measurement information and/or control information. Further, controller 310 may also be connected to utility service 312. The fire pump control system 300 includes service conductors 504 and feeder conductors 506. The controller 310 is connected to utility power source 312 via the service conductors 504, and the controller is connected to the fire pump system 302 via the feeder conductors 506.

The fire pump control system 300 further includes a pressure sensing line 508 connecting the controller and the fire pump system 302. The pressure sensing line 508 may be connected to a pressure transducer 512, and the pressure transducer may be configured to monitor the pressure of the fire pump system 302. Example pressure measurements and monitoring are described in greater detail below.

The fire pump control system 300 may also include a remote start connection 510 connecting the controller 310 and the fire pump 304. The remote start connection 510 may be configured to remotely start the fire pump is situations requiring the remote start of the fire pump 304. Controller 310 may also include a modbus data port 514, and this data port may allow communication between the controller 310 and various other elements of the fire pump control system 300. For instance, controller 310 may communicate with various elements of the system 300 so as to control operation of the system and/or to monitor system status. Example communications via a modbus port will be described in greater detail below.

As indicated above, in accordance with the present disclosure, a controller may be installed upstream of the service entrance of a fire pump system so as to provide overcurrent protection for the fire pump system as well as enhanced functionality for the fire pump system. In an example, the method may be operable in a fire pump control system that has a given full load current and includes (i) a fire pump, (ii) a maintenance pump, (iii) a first disconnect switch and (iv) a first circuit breaker, such as fire pump system 302. The method may involve installing a controller upstream of the first disconnect switch and first circuit breaker. The controller comprises a second disconnect switch and a second circuit breaker. Further, the controller is configured to control operation of at least one of the fire pump or the maintenance pump, is further configured to avoid (i) opening within two minutes at 600 percent of the full load current, (ii) opening with a restart transient of 24 times the full load current, and (iii) opening within 10 minutes at 300 percent of the full load current.

In accordance with example embodiments, the disclosed controller may be installed in new fire pump system installation scenarios to provide control and enhanced functionality to the newly installed fire pump system. For instance, in an example, fire pump system 302 may be a newly installed fire pump system and controller 310 may be installed at the same time or near the same time as the fire pump system. As another example, the disclosed controller may be installed in existing legacy fire pump systems so as to upgrade existing fire pump systems to provide greater control and functionality to existing legacy fire pump systems. For instance, the fire pump system 302 may be a legacy fire pump system, having a legacy fire pump 304 and legacy fire pump controller 320. Controller 310 may provide significant improved functionality to the legacy fire pump system.

As is known in the art, legacy fire pump controllers may have limited functionality. For instance, many legacy fire pump controllers may be fitted with mercoid pressure switches, and these legacy controllers may not provide any voltage and current metering or data connectivity. Controller 310 may then be added to the fire pump system 302 to provide both overcurrent protection and improved control functionality. Thus, beneficially, the controller 310 may provide an upstream disconnect that improves arc-flash safety and also enhanced functionality for control of the fire pump system. As a result, the controller in accordance with the present disclosure offers significant advantages for the retrofit market, as the controller can be installed to operate with legacy systems.

Various enhanced controller functions are possible. For instance, the upstream controller may be configured to perform monitoring or control operations of a fire pump and/or maintenance pump of the fire control system. Further, the upstream controller may be configured to facilitate communication between various component of the fire pump system and/or to facilitate communication between different fire pump systems. In addition, the upstream controller may provide enhanced visual indications, which may be beneficial for fire-pump-system operators or fire-pump-system maintenance.

An example fire pump controller is described in U.S. patent application Ser. No. 13/410,574, filed Mar. 2, 2012, assigned to Asco Power Technologies, L.P., the entirety of which is hereby incorporated herein by reference. The controller 310 may provide the controller function described in U.S. patent application Ser. No. 13/410,574.

Example communications between various components of a fire pump system are described in U.S. patent application Ser. No. 13/908,934, filed Jun. 3, 2013, assigned to Asco Power Technologies, L.P., the entirety of which is hereby incorporated herein by reference. The controller 310 may facilitate the communications described in U.S. patent application Ser. No. 13/908,934.

Example visual indications of a fire pump controller are described in U.S. patent application Ser. No. 13/908,922, filed Jun. 3, 2013, assigned to Asco Power Technologies, L.P., the entirety of which is hereby incorporated herein by reference. The controller 310 may provide the example functionality described in U.S. patent application Ser. No. 13/908,922.

Exemplary embodiments have been described above. Those skilled in the art will understand, however, that changes and modifications may be made to these embodiments without departing from the true scope and spirit of the invention.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A fire pump control system comprising:

a pump system having a given full load current, wherein the pump system comprises (i) a fire pump, (ii) a first disconnect switch and (iii) a first circuit breaker, wherein the first disconnect switch and the first circuit breaker are located downstream of a service entrance of the pump system, and wherein the first disconnect switch and the first circuit breaker are located upstream of the fire pump; and a first controller configured to control operation of the fire pump, wherein the first controller comprises a second disconnect switch and a second circuit breaker;

wherein the first controller, the second disconnect switch and the second circuit breaker are located upstream of the service entrance, the first disconnect switch and the first circuit breaker;

wherein the first controller is configured to avoid (i) opening within two minutes at 600 percent of the full load current, (ii) opening with a restart transient of 24 times the full load current, and (iii) opening within 10 minutes at 300 percent of the full load current.

2. The fire pump control system of claim 1, wherein a trip point for the second circuit breaker is not field adjustable.

3. The fire pump control system of claim 1, wherein the first controller further comprises an electronic circuit board comprising:

a programmable microprocessor, the microprocessor configured to (i) receive a signal indicating a pressure value, and (ii) compare the pressure value to a threshold for initiating operation of the fire pump; and a memory operatively coupled to the programmable microprocessor, the memory being configured to store event statistics that are representative of fire pump operation.

4. The fire pump control system of claim 1, wherein the second circuit breaker comprises a magnetic circuit breaker.

5. The fire pump control system of claim 1, wherein the pump system further comprises a second controller, wherein the first controller is configured to communicate via a wired connection with the second controller.

6. The fire pump control system of claim 5, wherein the first controller is a retrofit controller, and wherein the second controller is a legacy controller.

7. The fire pump control system of claim 1, further comprising:

service conductors; and feeder conductors;

wherein the first controller is connected to a utility power source via the service conductors, and wherein the first controller is connected to the fire pump system via the feeder conductors.

8. The fire pump control system of claim 1, further comprising a pressure sensing line connecting the first controller and the pump system.

9. The fire pump control system of claim 1, further comprising a remote start connection connecting the first controller and the fire pump.

10. A fire pump control system comprising:

a pump system having a given full load current, wherein the pump system comprises (i) a fire pump, (ii) a maintenance pump, (iii) a first disconnect switch and (iv) a first circuit breaker, wherein the first disconnect switch and the first circuit breaker are located downstream of a service entrance of the pump system, and wherein the first disconnect switch and the first circuit breaker are located upstream of the fire pump and maintenance pump; and a first controller configured to control operation of at least one of the fire pump or the maintenance pump, wherein the first controller comprises a second disconnect switch and a second circuit breaker;

wherein the first controller, the second disconnect switch and the second circuit breaker are located upstream of the service entrance, the first disconnect switch and the first circuit breaker;

wherein the first controller is configured to avoid (i) opening within two minutes at 600 percent of the full load current, (ii) opening with a restart transient of 24 times the full load current, and (iii) opening within 10 minutes at 300 percent of the full load current.

11. The fire pump control system of claim 10, wherein the first controller is configured to control operation of the maintenance pump, and wherein the first controller further comprises:

an electronic circuit board comprising a programmable microprocessor, the microprocessor configured (i) to receive a signal indicating a pressure value, and (ii) to compare the pressure value to a threshold for initiating operation of the maintenance pump; and a memory operatively coupled to the programmable microprocessor, the memory being configured to store event statistics that are representative of maintenance pump operation.

12. The fire pump control system of claim 10, wherein the first controller is configured to control operation of the fire pump, and wherein the first controller further comprises an electronic circuit board comprising:

a programmable microprocessor, the microprocessor configured to (i) receive a signal indicating a pressure value, and (ii) compare the pressure value to a threshold for initiating operation of the fire pump; and a memory operatively coupled to the programmable microprocessor, the memory being configured to store event statistics that are representative of fire pump operation.

13. The fire pump control system of claim 10, wherein a trip point for the second circuit breaker is not field adjustable.

14. The fire pump control system of claim 10, wherein the second circuit breaker comprises a magnetic circuit breaker.

15. The fire pump control system of claim 10, wherein the pump system further comprises a second controller, wherein the first controller is configured to communicate via a wired connection with the second controller.

16. The fire pump control system of claim 15, wherein the first controller is a retrofit controller, and wherein the second controller is a legacy controller.

17. The fire pump control system of claim 10, further comprising:

service conductors; and feeder conductors;

wherein the first controller is connected to a utility power source via the service conductors, and wherein the first controller is connected to the fire pump system via the feeder conductors.

18. A method operable in a fire pump control system, the fire pump control system comprising a pump system having a given full load current, wherein the pump system comprises (i) a fire pump, (ii) a maintenance pump, (iii) a first disconnect switch (iv) a first circuit breaker and (v) a service entrance located upstream of the first disconnect switch and the first circuit breaker, the method comprising:

installing a first controller upstream of the first disconnect switch and the first circuit breaker, wherein the first controller is configured to control operation of at least one of the fire pump or the maintenance pump, wherein the first controller comprises a second disconnect switch and a second circuit breaker, and wherein the first controller, the second disconnect switch and the second circuit breaker are located upstream of the service entrance, the first disconnect switch and the first circuit breaker;

wherein the first controller is further configured to avoid (i) opening within two minutes at 600 percent of the full load current, (ii) opening with a restart transient of 24 times the full load current, and (iii) opening within 10 minutes at 300 percent of the full load current.

* * * * *